US009361862B2

(12) United States Patent
Klemarewski

(10) Patent No.: US 9,361,862 B2
(45) Date of Patent: Jun. 7, 2016

(54) PASSIVE AMPLIFICATION SYSTEM FOR STRINGED INSTRUMENTS

(71) Applicant: Andrzej Marek Klemarewski, North Vancouver (CA)

(72) Inventor: Andrzej Marek Klemarewski, North Vancouver (CA)

( * ) Notice: Subject to any disclaimer, the term of this patent is extended or adjusted under 35 U.S.C. 154(b) by 0 days.

(21) Appl. No.: 14/837,278

(22) Filed: Aug. 27, 2015

(65) Prior Publication Data

US 2016/0093279 A1 Mar. 31, 2016

Related U.S. Application Data

(60) Provisional application No. 62/071,483, filed on Sep. 26, 2014.

(51) Int. Cl.
*G10D 3/02* (2006.01)
*G10H 3/18* (2006.01)

(52) U.S. Cl.
CPC . *G10D 3/02* (2013.01); *G10H 3/181* (2013.01)

(58) Field of Classification Search
CPC ..... G10D 3/02
USPC ..... 84/294
See application file for complete search history.

(56) References Cited

U.S. PATENT DOCUMENTS 1,431,773 A 10/1922 Bond
1,560,372 A 11/1925 Berge
1,752,906 A * 4/1930 Hillebrandt ..... G10D 1/06 84/294
1,762,617 A 6/1930 Dopyera
1,808,756 A * 6/1931 Beauchamp ..... G10D 3/02 84/296
1,847,303 A * 3/1932 Finney ..... G10D 1/12 84/173
1,863,344 A * 6/1932 Lange ..... G10D 1/08 84/267
1,883,503 A * 10/1932 Blondin ..... G10D 1/00 84/173
1,927,575 A * 9/1933 Sehireson ..... G10D 3/02 84/296
1,961,900 A * 6/1934 Gast ..... G10D 3/02 84/294
1,962,919 A * 6/1934 Stimson ..... G10H 3/185 381/118
2,027,723 A * 1/1936 Dopyera ..... G10D 3/02 84/296
2,045,265 A * 6/1936 Dopyera ..... G10D 3/02 84/267
2,139,099 A * 12/1938 Robertson ..... G10D 3/02 84/296
2,558,893 A * 7/1951 Wolff ..... G10D 3/02 84/280
2,660,912 A * 12/1953 Prescott ..... G10D 3/02 84/291
2,853,146 A 9/1958 Coates
3,004,620 A * 10/1961 Baschet ..... G10H 3/12 116/137 A
3,233,495 A * 2/1966 Bernardi ..... G10D 3/02 84/294
3,788,183 A * 1/1974 Mariner ..... G10D 1/08 84/291
4,031,798 A * 6/1977 Sidner ..... G10D 3/02 84/194
4,068,553 A * 1/1978 Dopyera ..... G10D 3/06 84/267
4,104,945 A * 8/1978 Bolin ..... G10K 11/08 84/189
4,172,404 A * 10/1979 Dopyera ..... G10D 3/06 84/291
4,464,967 A * 8/1984 Trimborn ..... G10D 1/085 84/743
4,616,550 A * 10/1986 Lacroix ..... G10D 3/06 84/173
4,637,290 A * 1/1987 Grawi ..... G10D 3/143 84/173
4,915,009 A * 4/1990 Kunstadt ..... G10H 3/18 84/291
5,355,756 A 10/1994 Geiger (Continued)

FOREIGN PATENT DOCUMENTS

GB 2413470 5/2004
JP 7-295557 11/1995

*Primary Examiner* — David Warren
(74) *Attorney, Agent, or Firm* — Smiths IP

(57) ABSTRACT

A passive amplifier for a stringed instrument (such as an electric guitar) comprises a pickup and a resonator. The pickup is removably attached at one end to the headstock of the stringed instrument and extends substantially normal to the headstock. The resonator is attached to the other end of the pickup. The resonator has a generally flared structure. An aperture in the pickup extends from one end to the other end.

26 Claims, 9 Drawing Sheets

(56) References Cited

U.S. PATENT DOCUMENTS 5,567,896 A * 10/1996 Gottschall ..... G10D 3/02 84/294
5,602,354 A * 2/1997 Martin ..... G10D 13/06 84/410
5,661,252 A * 8/1997 Krawczak ..... G10D 3/06 84/291
5,780,758 A * 7/1998 McGill ..... G10D 3/02 84/296
5,892,184 A 4/1999 D'Hoogh
5,981,861 A * 11/1999 Van Delinder ..... G10H 3/00 84/743
6,040,510 A * 3/2000 Yaun ..... G10D 3/02 84/294
6,044,925 A 4/2000 Sahyoun
6,051,764 A * 4/2000 Sakurai ..... G10D 3/02 84/290
6,563,033 B1 5/2003 Porzilli
2003/0070527 A1* 4/2003 Gregory ..... G10D 3/14 84/290
2003/0121393 A1* 7/2003 Brown ..... G10D 1/00 84/291
2003/0164086 A1* 9/2003 Evers ..... G10H 3/187 84/743
2004/0003701 A1* 1/2004 Van Epps ..... G10D 1/08 84/294
2004/0050236 A1* 3/2004 Geiger ..... G10D 3/02 84/294
2006/0048625 A1* 3/2006 Geiger ..... G10D 3/02 84/294
2006/0130632 A1* 6/2006 Geiger ..... G10D 3/02 84/294
2007/0204741 A1* 9/2007 Ramos ..... G10D 3/02 84/291
2008/0053289 A1* 3/2008 Bryan ..... G10D 1/08 84/291
2008/0226109 A1 9/2008 Yamakata
2009/0188370 A1* 7/2009 DeJule ..... G10D 3/046 84/294
2011/0174133 A1* 7/2011 Unkert ..... G10D 3/14 84/293
2012/0234153 A1* 9/2012 D'Anda ..... G10D 3/02 84/294
2013/0228060 A1* 9/2013 Linden ..... G10D 3/02 84/267
2014/0150627 A1* 6/2014 Chekardzhikov ..... G10G 7/02 84/455
2015/0082970 A1* 3/2015 Chekardzhikov ..... G10G 7/02 84/455

* cited by examiner

PASSIVE AMPLIFICATION SYSTEM FOR STRINGED INSTRUMENTS

CROSS REFERENCE TO RELATED APPLICATIONS

This application claims the benefit of U.S. Provisional Patent Application No. 62/071,483 filed Sep. 26, 2014, the contents of which are hereby incorporated by reference.

FIELD OF THE INVENTION

The present invention relates to amplification systems for musical instruments, and in particular, to passive amplification systems for stringed instruments such as electric guitars.

BACKGROUND OF THE INVENTION

In stringed musical instruments, sound is produced from vibrating strings. In an electric guitar, for example, strings are attached on one end to a solid guitar body and on the other end to tuning pegs on a headstock. In order to generate sound, the strings are strummed, with the resultant vibrations generating sound waves.

Unpowered electric guitars generate low levels of acoustic sound on their own. Instead, they are designed to operate with an electric amplification device. When the strings of an electric guitar are plucked, the vibration of the strings generates signals in the form of small electric currents in the magnetic pickups. These signals are fed to an amplifier, which transforms and amplifies the signals into audible sound.

Unlike acoustic guitars (which have hollow bodies), electric guitars typically have solid, heavy bodies. As a result, string vibrations in an electric guitar do not cause much resonance in the body. However, string vibrations in an electric guitar do cause significant resonance in the neck, which is typically much thinner and lighter than the body. The headstock (located at the end of the neck) is subject to the greatest degree of resonance.

Acoustic guitars, because of their construction, are loud enough on their own and do not require any external amplification for practicing or for performing in small rooms. In fact, acoustic guitars may be too loud for practicing late at night in an apartment building.

As discussed earlier, unpowered electric guitars produce acoustic sounds at levels that are too low to be enjoyed without electrical amplification. A typical amplification system involves an amplifier and one or more speakers. They also require electrical power and cabling. This makes spontaneous playing or practicing impractical. In addition, the relatively loud level of sound produced by an amplified electric guitar may be uncomfortable for people in the vicinity. Miniature amplifiers with smaller speakers and/or headphones are known. However, the sound quality of these small speakers is typically inferior (due to their small size). The use of headphones for extended periods of time may be tiring and requires the use of cabling.

U.S. Pat. No. 1,431,773 (Bond) discloses a custom stringed instrument where bridge vibrations are transferred to a diaphragm, with the resultant sound waves projected through a horn. However, Bond requires a custom instrument and cannot be used with conventional stringed instruments.

U.S. Pat. No. 1,762,617 (Dopyera) discloses another custom stringed instrument where bridge vibrations are transferred via mechanical arms to a number of metallic resonators built into the body of the instrument. As with Bond, Dopyera is a custom instrument that cannot be used with conventional stringed instruments. Furthermore, Dopyera produces a distinct metallic sound that is markedly different from those of a wooden acoustic or electric guitar.

U.S. Pat. No. 2,558,893 (Wolff) discloses a custom stringed instrument where a conic speaker is attached directly under the bridge. The bridge is mechanically linked with the apex of the speaker, and the strings' vibrations are transferred to the speaker for amplification. As with Bond and Dopyera, Wolff requires a custom instrument and cannot be used with conventional stringed instruments.

U.S. Pat. No. 4,428,268 (Ingoglia) discloses a self-contained guitar amplification system. The system does not require electricity but instead uses air tubes for transmitting sound from a pickup to an insulated headset. The sound quality of such a system is relatively poor and limited by the size of the air tubes. In particular, small-diameter tubes will significantly restrict sound frequency. Furthermore, the headset in Ingoglia is bulky and tiring to use for prolonged periods.

SUMMARY OF THE INVENTION

In one embodiment of the present invention, an amplifier for a stringed instrument with a headstock comprises a pickup and a resonator. The pickup comprises first and second ends, wherein the pickup is removably attached to the headstock proximate to the second end. The resonator is attached to the pickup proximate to the first end, wherein the resonator comprises a generally flared structure.

In another embodiment, the pickup further comprises an aperture extending between the first end and the second end. The aperture comprises a first diameter at the first end and a second diameter at the second end.

In a further embodiment, the first diameter is greater than the second diameter.

In still another embodiment, the pickup has a generally rectangular cross-section.

In yet another embodiment, the pickup is made of one or more of the following materials: wood, plastic, glass fiber composites, graphite composites, and aluminum. If the pickup is made of wood, it may be made of one or more of the following types: Douglas Fir, Western Hemlock, Sitka Spruce, Radiata Pine, and Mahogany.

In another embodiment, the pickup extends substantially normal to the headstock.

In a further embodiment, the pickup further comprises a resonating gap proximate to the second end, wherein the resonating gap comprises a passageway between the aperture and an exterior of the pickup.

In still a further embodiment, the generally flared structure comprises a generally conic section.

In another embodiment, the generally flared structure comprises a generally pyramidal structure.

In yet another embodiment, the pickup further comprises a fastener opening proximate to the first end, and the resonator comprises a resonator opening proximate to an apex of said resonator. The amplifier further comprises a fastener engaging both the fastener opening and the resonator opening to secure the resonator to the pickup. The fastener may comprise a bolt.

In still yet another embodiment, the amplifier further comprises a resonating strip and one or more spacers, wherein the resonating strip is situated between the pickup and the resonator, and wherein the spacers separate the resonating strip from the pickup. The resonating strip may comprise a strip opening for engagement with the fastener.

In another embodiment, the resonator is made of one or more of the following materials: paper, plastic film, wood veneer, metallic foil, and polyester film.

In a further embodiment, the resonator is formed from a substantially flat cutout, wherein the cutout comprises a slit separating two adjacent edges and wherein one of the adjacent edges is slid across another of the adjacent edges to form the generally flared structure. The cutout may be generally circular or generally rectangular in shape.

In still a further embodiment, the cutout is capable of being rolled into a generally cylindrical shape for storage.

In yet a further embodiment, the resonator is molded.

In another embodiment, the amplifier further comprises a stiffener, wherein the stiffener comprises a stiffener opening for engagement with the fastener, and wherein at least a portion of the stiffener comes into contact with an interior surface of the resonator.

In still another embodiment, the stiffener is made of one or more of the following materials: paper and plastic.

In yet still another embodiment, the stiffener is made from material thicker than that of the resonator.

In another embodiment, the amplifier comprises an attachment mechanism for removably attaching the pickup to the headstock. The attachment mechanism may comprise one of the following: clamp, clip, clasp, strap, bolt, and tie.

In a further embodiment, the pickup comprises an attachment point for engagement of the pickup with the attachment mechanism.

The foregoing was intended as a summary only and of only some of the aspects of the invention. It was not intended to define the limits or requirements of the invention. Other aspects of the invention will be appreciated by reference to the detailed description of the preferred embodiments. Moreover, this summary should be read as though the claims were incorporated herein for completeness.

BRIEF DESCRIPTION OF THE DRAWINGS

The preferred embodiment of the invention will be described by reference to the drawings thereof, in which.

DETAILED DESCRIPTION

Figure 1:
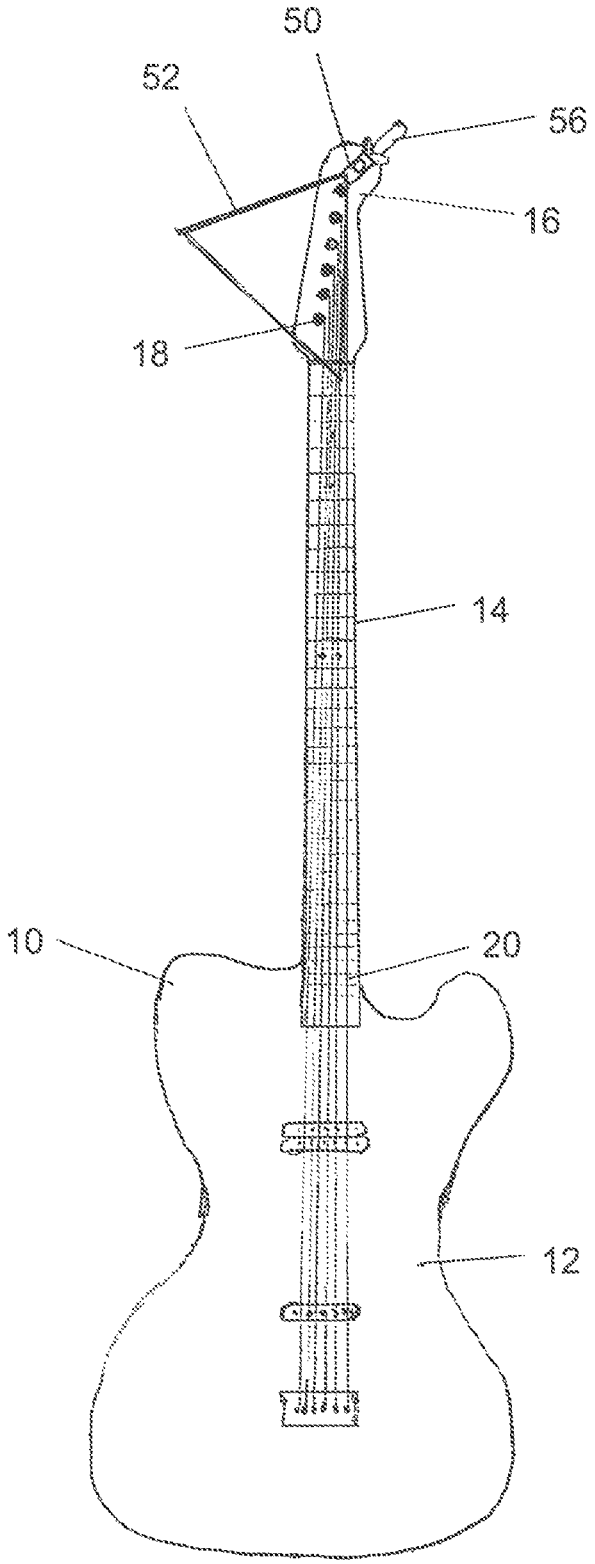
FIG. 1 is a front view of an electric, guitar to which the passive amplifier in accordance with the present invention is attached.
Figure 2:
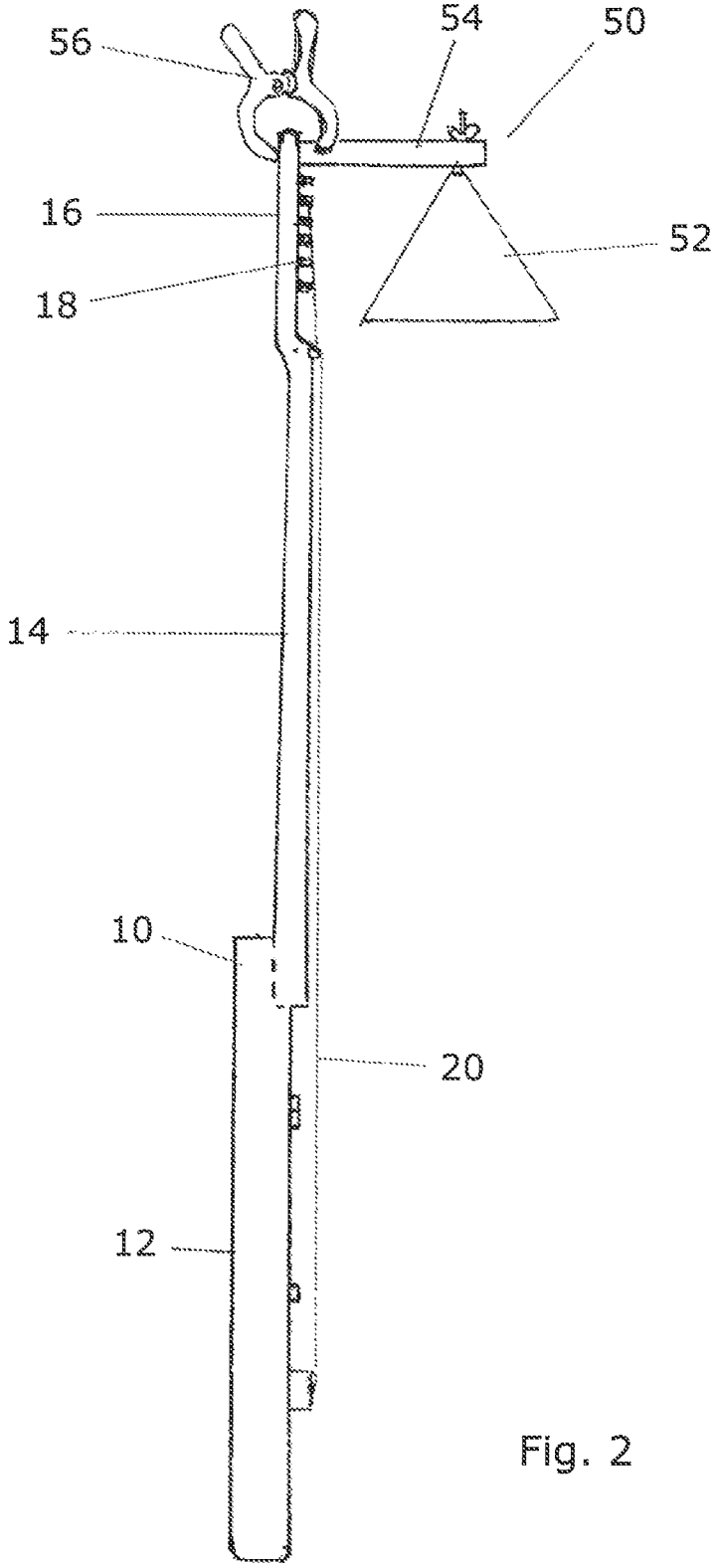
FIG. 2 shows a side view of an electric guitar with the passive amplifier attached.

Referring to FIGS. 1 and 2, a conventional electric guitar 10 comprises a body 12 with a neck 14 and a headstock 16. One or more machine heads 18 may be located on the headstock 16 for tuning the electric guitar 10 (by adjusting the tension of one or more strings 20). A passive amplifier 50 according to the invention is attached to the headstock 16. The headstock 16 is subject to vibrations induced by the plucking or strumming of the strings 20 by a player.

The passive amplifier 50 comprises a resonator 52 and a post or pickup 54. The pickup 54 may be attached to the headstock 16 using an attachment mechanism 56. In one embodiment, the attachment mechanism 56 is a clamp; however, other mechanisms are also contemplated, such as clips, clasps, straps, bolts, ties, etc. Preferably, the attachment mechanism 56 allows for the pickup 54 to be detached from the headstock 16 when the passive amplifier 50 is not needed.

The overall shape of the pickup 54 may take several forms. For example, the pickup 54 may have a round, square, or rectangular cross-section. However, the cross-sectional dimensions of the pickup 54 should be such that the pickup 54 will fit on the headstock 16 of conventional electric guitars 10. It has been found that pickups 54 with rectangular cross-sections of approximately 15×19 mm provide good stability and fit most electric guitars 10. The overall length of the pickup 54 may also vary. For example, the pickup 54 may have a length between approximately 100 and 200 mm. Preferably, the length of the pickup 54 is sufficient to allow for clearance of the resonator 52. However, if the pickup 54 is too long, sound output is lowered. In one embodiment, the pickup 54 comprises an attachment point 57 that facilitates the securing of the attachment mechanism 56 to the pickup 54. In the embodiment shown in FIG. 3, the attachment point 57 is a notch located on the side of the pickup 54.

Preferably, the pickup 54 is made from material with good acoustic properties. The pickup 54 not only transfers vibrations from the headstock 16, it also vibrates and these vibrations contribute to the volume and quality of the sound generated by the resonator 52. Materials with good acoustic properties have a relatively high ratio of bending stiffness to density. For example, wood has good acoustic properties and has traditionally been used for making stringed instruments. In addition to wood, other suitable materials for the pickup 54 include rigid plastics, glass fiber composites, graphite composites, and aluminum. It has been found that pickups 54 made from clear, straight grain wood of the following species performed well: Douglas Fir, Western Hemlock, Sitka Spruce, Radiata Pine, and Mahogany.

Figure 3:
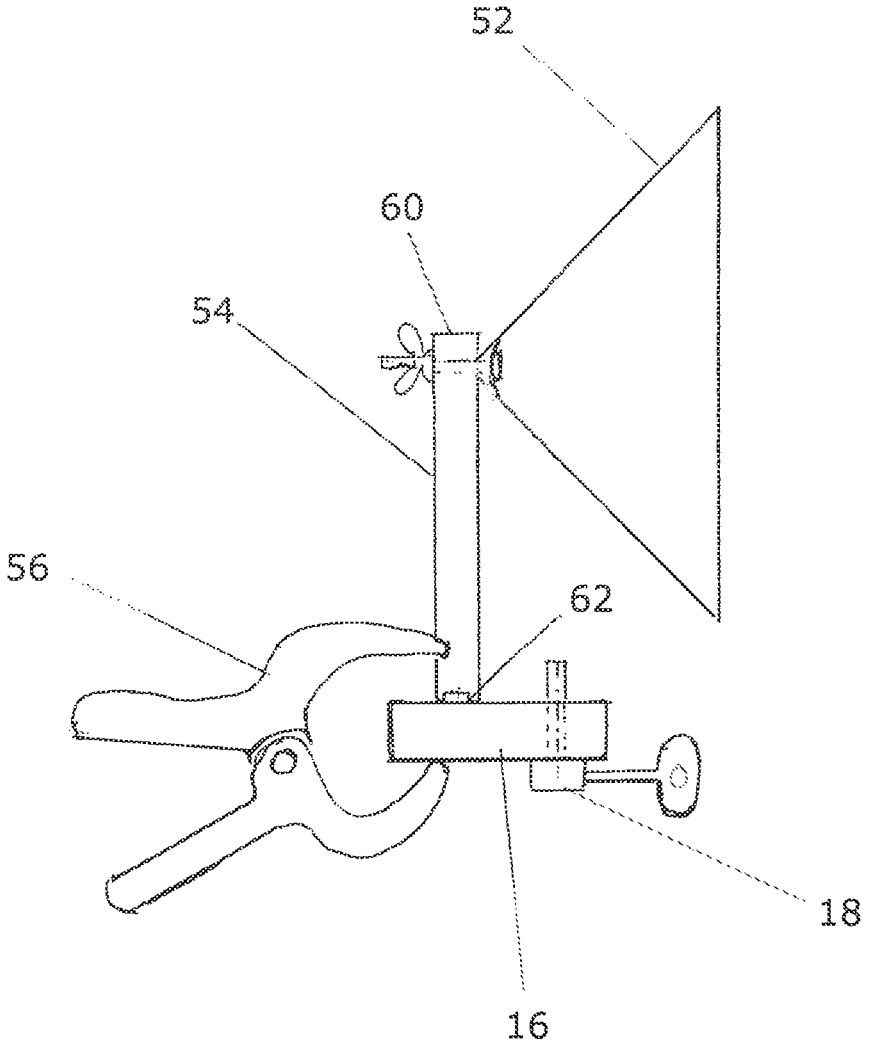
FIG. 3 is a side view of the passive amplifier attached to a headstock of an electric guitar.
Figure 4A:
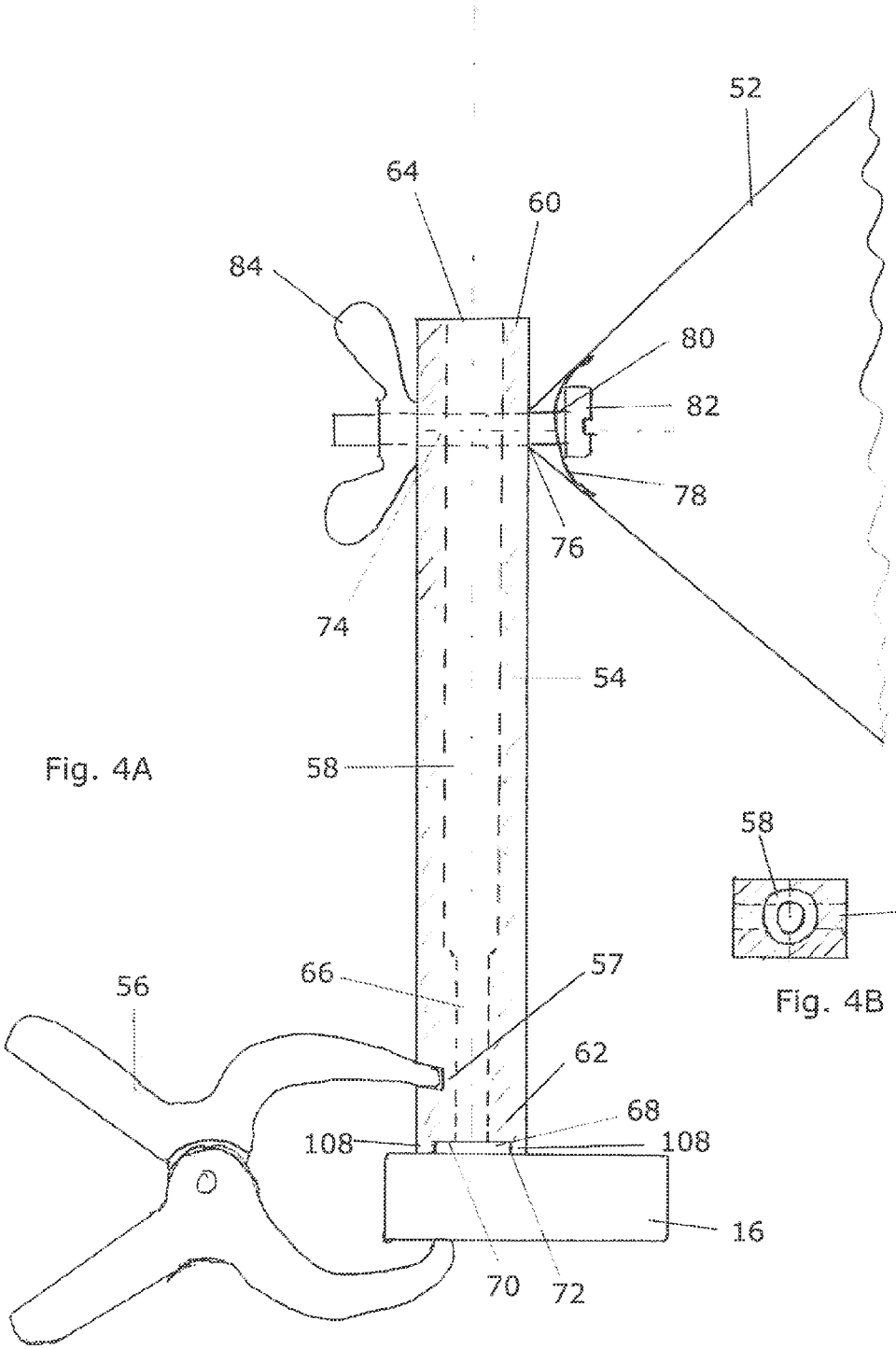
FIG. 4A is an enlarged view of the passive amplifier attached to a headstock of an electric guitar.
Figure 4B:
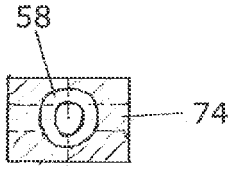
FIG. 4B is an end view of the pickup of the passive amplifier.

Referring to FIGS. 3 and 4A and 4B, when the pickup 54 is attached to the headstock 16, the pickup 54 preferably extends substantially normal from the plane of the headstock 16. The pickup 54 comprises first and second ends 60, 62, with an aperture 58 that extends between the first end 60 and the second end 62. Preferably, the aperture 58 has a first diameter 64 proximate to the first end 60 and a second diameter 66 proximate to the second end 62, with the first diameter 64 being greater than the second diameter 66. The first diameter 64 may be between approximately 6 and 10 mm, while the second diameter 66 may be between approximately 4 and 7 mm (for a pickup 54 with a cross-section of approximately 15×19 mm). However, other dimensions are also possible.

In another embodiment, the pickup 54 may be solid throughout (i.e. the aperture 58 is not present).

When the pickup 54 is attached to the headstock 16, the second end 62 contacts the headstock 16. The attachment mechanism 56 provides constant pressure on the pickup 54, and as a result, the surface of the headstock 16 is subject to a generally perpendicular force gradient. This perpendicular force gradient helps to ensure good physical contact between the second end 62 and the surface of the headstock 16.

Preferably, a portion of the pickup 54 is removed proximate to the second end 62 such that a resonating gap 68 is formed between the second end 62 and the headstock 16. As best shown in FIGS. 4A and 4B, the resonating gap 68 provides a passageway between the aperture 58 and the exterior of the pickup 54 proximate to the second end 62. The resonating gap 68 increases the level of sound amplification produced by the passive amplifier 50 and is defined, at least in part, by an upper edge 70, two opposed side edges 72, and the headstock 16. Preferably, the resonating gap 68 extends approximately 0.5 to 2 mm between the upper edge 70 and the headstock 16 and is approximately 13 mm wide (for a pickup 54 with a cross-section of approximately 15×19 mm). As a result of the resonating gap 68, two legs 108 may be formed at the second end 62.

Proximate to the first end 60, the resonator 52 is attached. The resonator 52 may be in the form of a generally flared structure, such as the generally conic structure shown in FIGS. 3 and 4A and 4B. The resonator 52 may be attached to the pickup 54 by a number of fastening mechanisms, including bolts, screws, nails, staples, adhesives, etc. As best shown in FIGS. 3 and 4A and 4B, a fastener opening 74 in the pickup 54 is provided. The fastener opening 74 extends substantially perpendicularly to the aperture 58 and may extend through the entire width of the pickup 54. The resonator 52 comprises a resonator opening 76, which is preferably located proximate to the apex of the resonator 52. The resonator opening 76 is placed over the fastener opening 74 such that the resonator opening 76 and the fastener opening 74 are generally aligned. A stiffener 78 may also be provided. The stiffener 78 comprises a stiffener opening 80, which is also aligned with the resonator opening 76 and the fastener opening 74.

An appropriate fastener 82 may be inserted through the stiffener opening 80, the resonator opening 76, and the fastener opening 74 to secure the stiffener 78 and the resonator 52 to the pickup 54. In the embodiment shown in FIG. 4A, the fastener 82 is a bolt that extends through the pickup 54. A wingnut 84 may be threaded onto the end of the fastener 82 to secure the fastener 82 to the pickup 54. The fastener 82 may be made from any suitable material, including metal or plastic. Preferably, materials with low mass (e.g. nylon bolts) are utilized.

Figure 5:
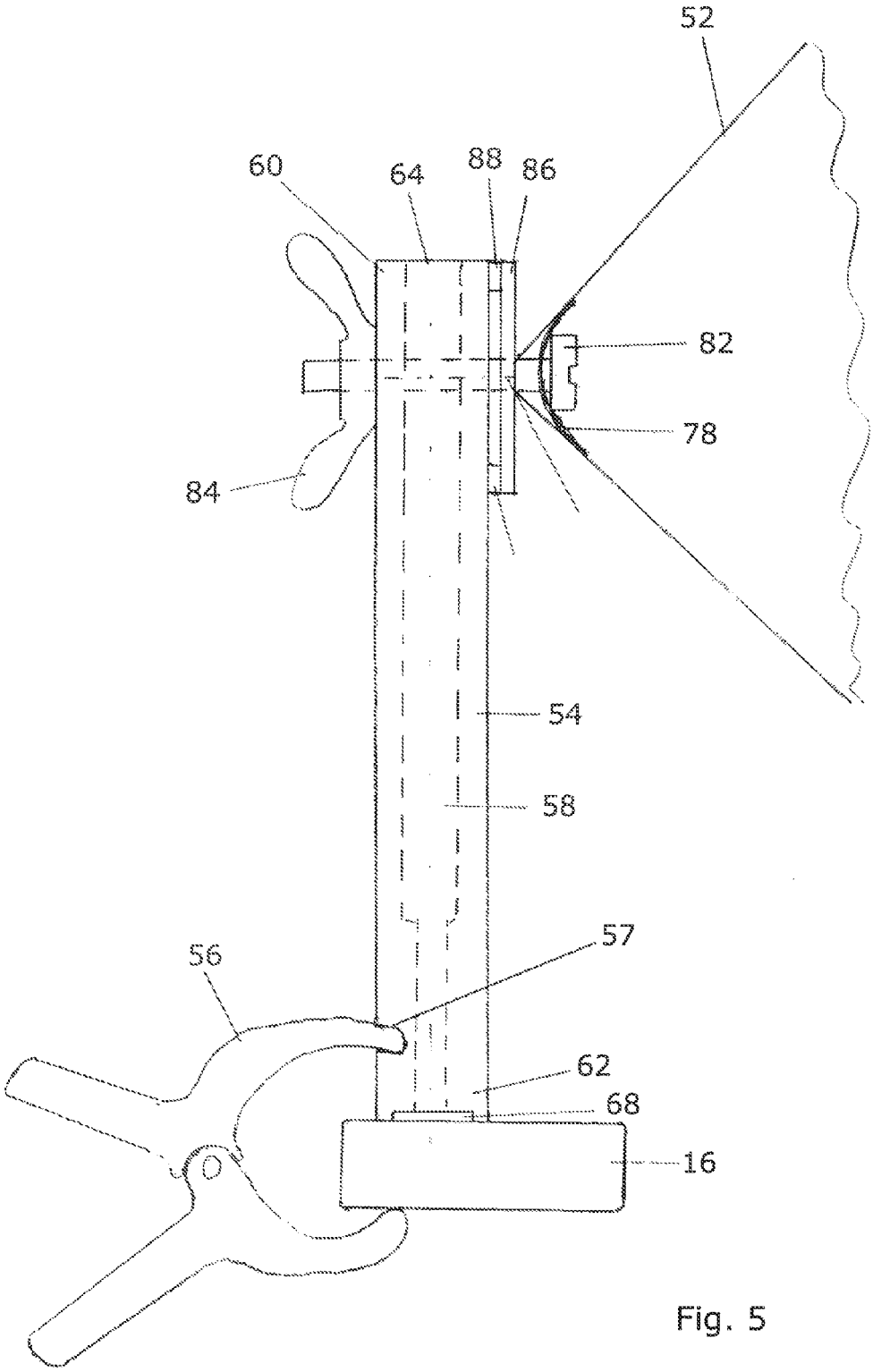
FIG. 5 shows another embodiment of the passive amplifier in accordance with the present invention.

In an alternative embodiment shown in FIG. 5, a resonating strip 86 is provided. The resonating strip 86 lies between the resonator 52 and the pickup 54. Preferably, the resonating strip 86 is between approximately 1.5 and 4.5 mm thick and between approximately 15 and 25 mm wide and approximately 40 and 60 mm long. The resonating strip 86 is itself separated from the pickup 54 by one or more spacers 88. The spacers are preferably between approximately 0.5 and 2.5 mm thick. The resonating strip 86 may also have a strip opening 110 to allow for the through passage of the fastener 82. The resonating strip 86 is preferably made from wood (e.g. Douglas Fir). Exemplary dimensions for the resonating strip $6 are approximately 15 mm wide, 60 mm long, and 3.5 mm thick.

Figure 6:
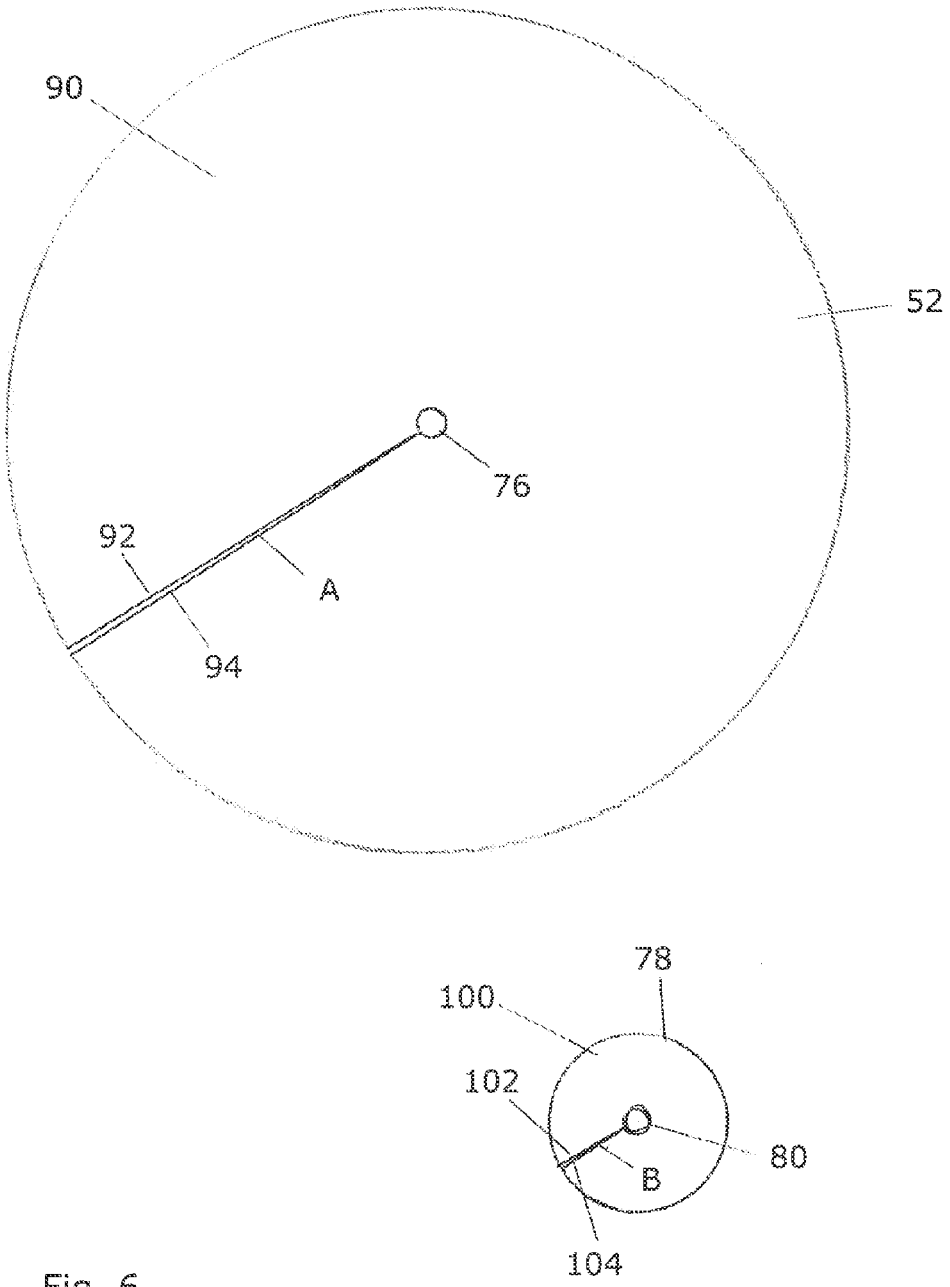
FIG. 6 is a top view of cutouts for a speaker and a stiffener for the passive amplifier before assembly, in accordance with a first embodiment.
Figure 7:
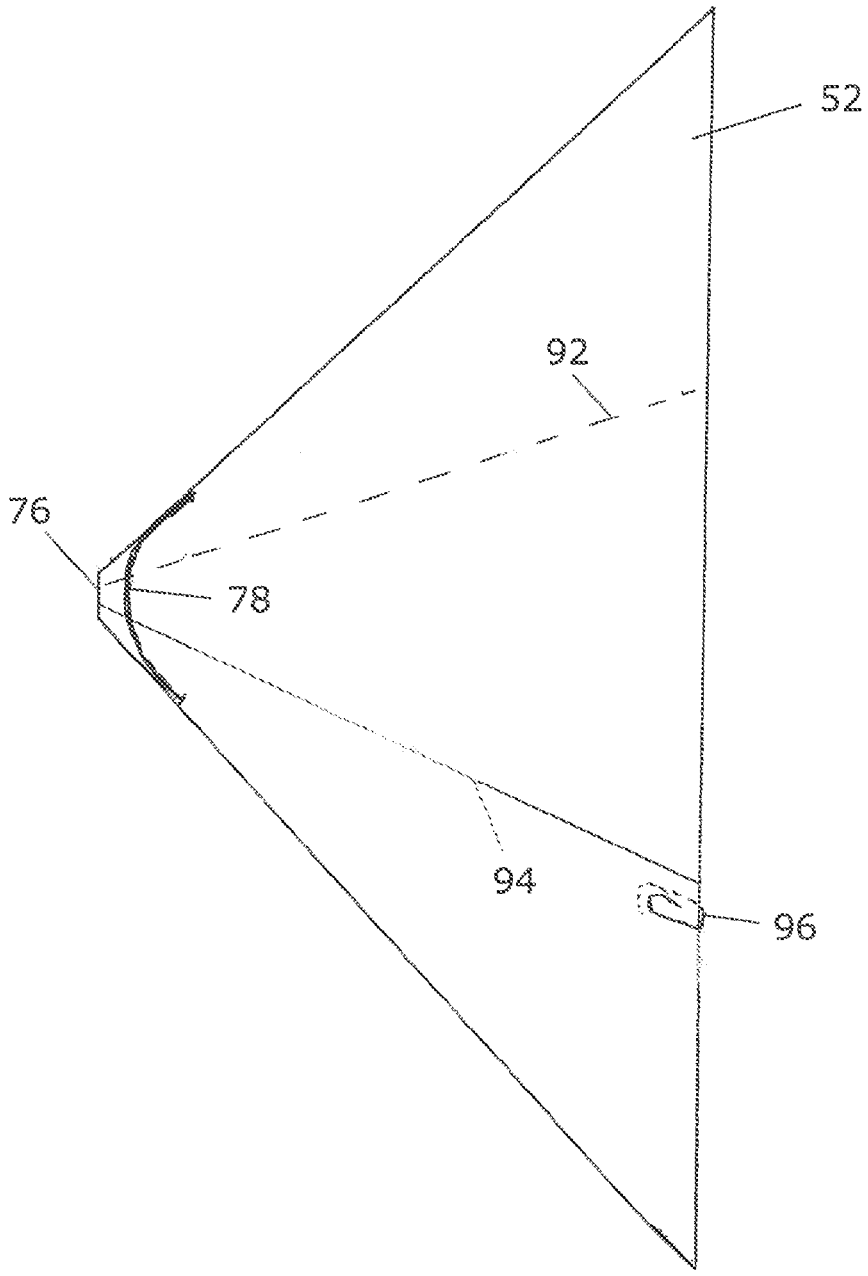
FIG. 7 is a side view of the speaker and stiffener of FIG. 6 after assembly.

As discussed above, the resonator 52 may be in the form of a generally conic section. Referring to FIGS. 6 and 7, the resonator 52 may be formed from a substantially flat and generally circular cutout 90 comprising the generally central resonator opening 76. After the circular cutout 90 is cut radially along line A to form adjacent edges 92, 94, one edge 92 may be slid across the other edge 94 to form the generally conic section. The shape of the conic section may be held in place using securing mechanism 96, such as adhesive tape or clips, to secure the resultant overlapping portions of the circular cutout 90 together.

Figure 8:
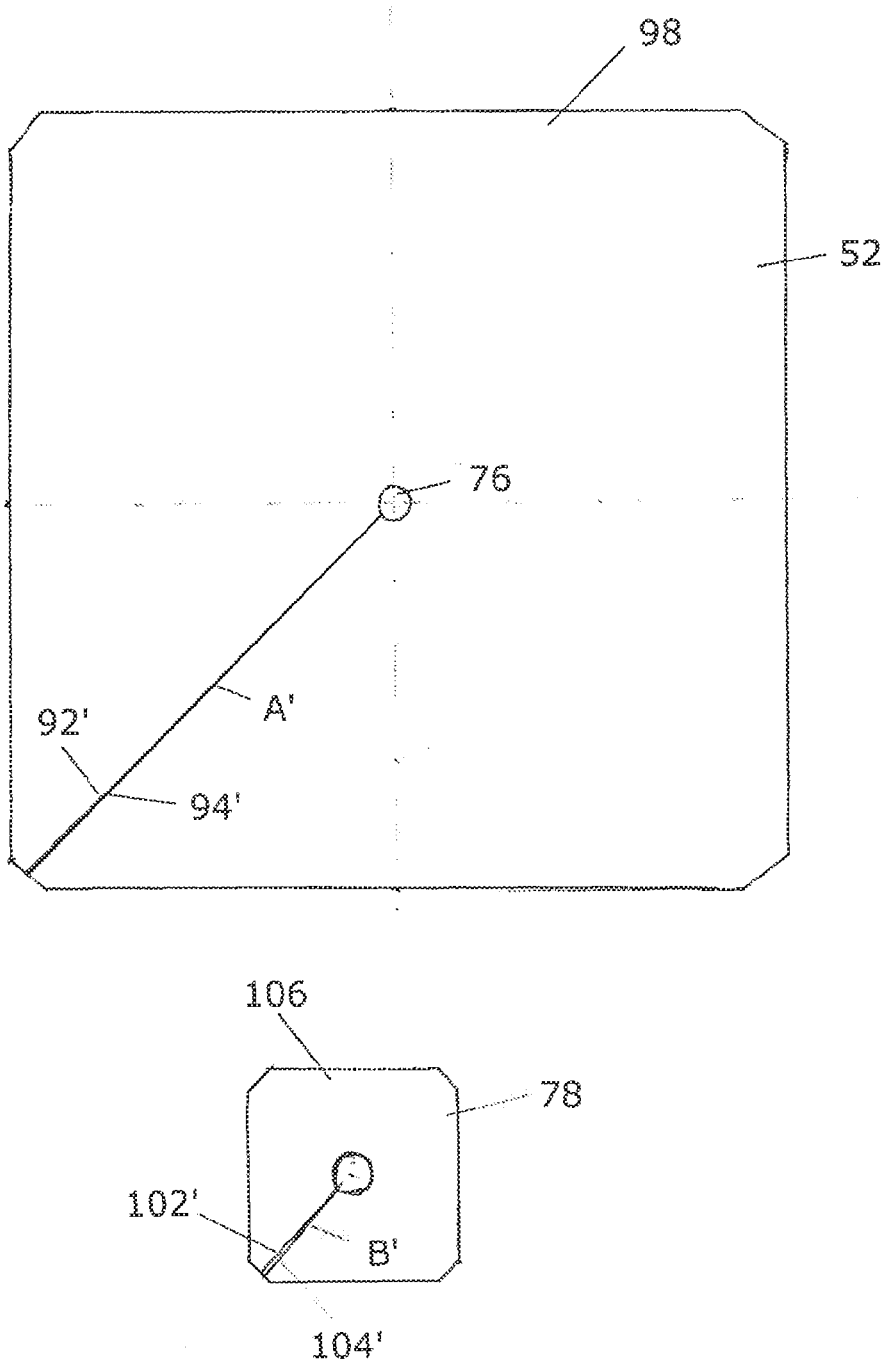
FIG. 8 is a top view of cutouts for a speaker and a stiffener for the passive amplifier before assembly, in accordance with a second embodiment.
Figure 9:
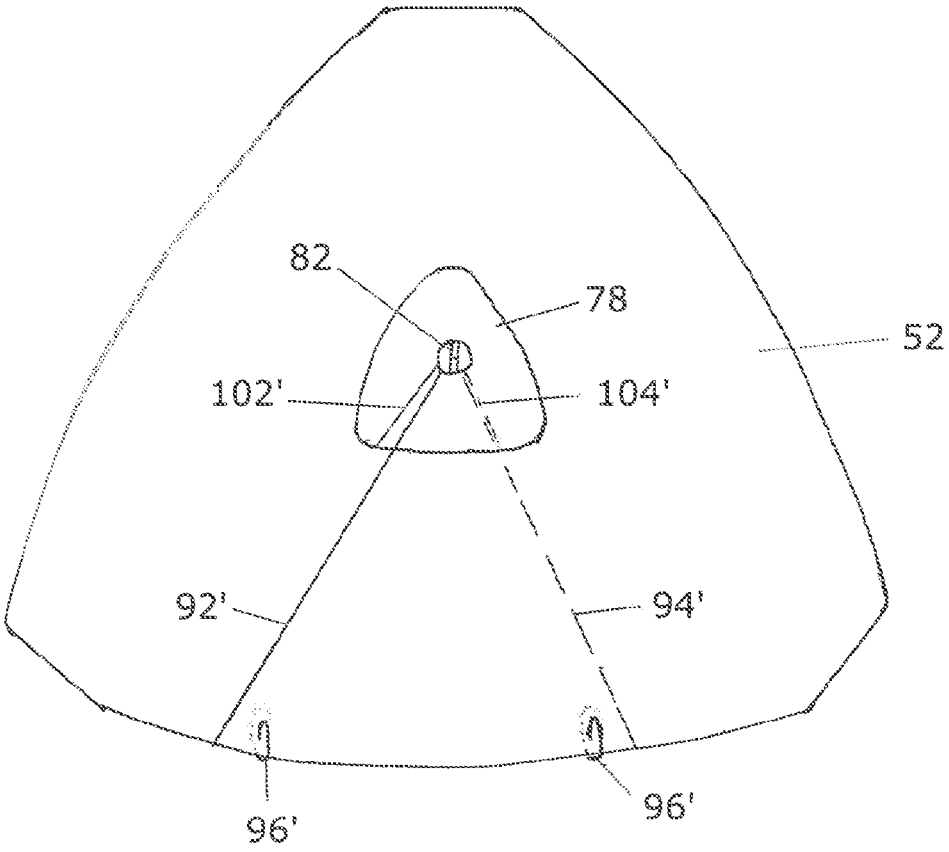
FIG. 9 is a front view of the speaker and stiffener of FIG. 8 after assembly.

In an alternative embodiment shown in FIGS. 8 and 9, the resonator 52 may take shapes other than a generally conic section. For example, in FIGS. 8 and 9, the resonator 52 may be formed from a substantially flat and generally square cutout 98 with the generally central resonator opening 76. The square cutout 98 may be cut diagonally alone line A' to form adjacent edges 92', 94'. One edge 92' may be slid across the other edge 94' to form a generally pyramidal section. The shape of the pyramidal section may be held in place using securing mechanism 96' (e.g. adhesive tape, clips, etc.) to secure the resultant overlapping portions of the square cutout 98 together.

The use of substantially flat circular cutout 90 or substantially flat square cutout 98 for forming the resonator 52 is that they can be rolled into a tubular shape for shipping and storage.

Although the cutouts shown in the Figures have a generally circular or generally rectangular shape, it is understood that other shapes for the cutouts are also possible.

Vibrations of the headstock 16 are transferred and conducted along the pickup 54 to the resonator 52. The resonator 52 is preferably made from thin and relatively stiff material, such as paper, coated paper, plastic film (such as polyester or polystyrene films), wood veneer, metallic foil, or other like material. One particular suitable material is polyester film (Mylar™) with a thickness of between approximately 0.1 and 0.25 mm.

The dimensions of the resonator 52 may vary. Suitable dimensions for resonator 52 include the base diameter of between approximately 200 and 230 mm, the resonator opening 76 of between approximately 5 to 7 mm (to allow for the insertion of the fastener 82), and the depth of between approximately 75 to 120 mm. Generally, resonators 52 with smaller diameters produce weaker sound, while ones with larger diameters produce stronger sound.

In a further alternative embodiment, the resonator 52 may be also molded into its final shape. This eliminates the need for the resonator 52 to be assembled from a flat cutout and to be held together using the securing mechanism 96. However, it is more expensive to manufacture and requires the production of a specialized mold. For example, the resonator 52 may be molded from polyvinyl chloride (PVC) material of approximately 0.25 mm thick.

The stiffener 78 provides stiffening action proximate to the apex of the resonator 52. As the fastener 82 is tightened against the stiffener 78, pressure is exerted against the stiffener 78, which in turn exerts pressure on the interior of the resonator 52. Preferably, the stiffener 78 is made from material that is thicker than the resonator 52. Suitable material includes paper or plastic (e.g. polyester or polystyrene film with a thickness of between approximately 0.2 and 0.4 mm).

The stiffener 78 may take the form of several shapes as well, such as circular, square, rectangular, etc. For example, in the embodiment shown in FIGS. 6 and 7, the stiffener 78 comprises the stiffener opening 80 and is formed from a second generally circular cutout 100 that is of a smaller diameter than that of the circular cutout 90. The second circular cutout 100 may be cut radially along line B to form second adjacent edges 102, 104. As the fastener 82 is secured onto to the pickup 54, the second circular cutout 100 will conform generally to the shape of the resonator 52 (e.g. a conic section) such that at least a portion of the stiffener 78 preferably comes into contact with the interior surface of the resonator 52. In the process, one of the second edges 102 may slide over the other second edge 104.

Similarly, in the embodiment shown in FIGS. 8 and 9, the stiffener 78 is formed from a second generally square cutout 106 of smaller dimensions than that of the square cutout 98. The second square cutout 106 may be cut diagonally along line B' to form second adjacent edges 102', 104'. As the fastener 82 is secured onto to the pickup 54, the second square cutout 106 will conform generally to the shape of the resonator 52 (e.g. a pyramidal section). In the process, one of the second edges 102' may slide over the other second edge 104'.

In a further alternative embodiment, the stiffener 78 may also be molded into its final shape, eliminating the need for the stiffener to be assembled from a flat cutout.

Tests

Example 1

Tests were conducted to measure the performance of the passive amplifier 50. A Godin SDX electric guitar with a holt-on neck was used for the loudness measurements. This type of guitar is similar in design to the Fender Stratocaster, which is one of the most popular electric guitars in the market. The electric guitar 10 was placed flat on a table on a layer of foam. In order to apply repetitive and constant string striking force, a pendulum system was installed. A pendulum was lifted to a fixed distance and released. At the end of the pendulum, a soft rubber tube was installed, which would strike the strings 20 as the pendulum passed over the electric guitar 10.

A Samson GoMic condenser-type microphone was connected to a computer. Orban loudness measuring software was used to calculate signal values. This software has several loudness meters. In this test, PPM loudness meter was used.

The microphone was placed 50 cm above the seventeenth guitar fret and 80 cm from the end of the headstock 16. This position is approximately the same distance from the strings 20 to a guitar player's left ear during guitar playing.

Measurements were carried out for non-powered guitar sound, both with open strings and with a capo placed on the third fret simulating a bar chord. The same measurements were then repeated with the passive amplifier 20 attached to the end of the headstock 16. The passive amplifier 20 comprised a Douglas Fir pickup 54 with a 15×19 mm cross-section, a 9.5-mm hole drilled on the first end 60 and a 6-mm diameter on the second end 62, a 1.0-mm resonating gap on the second end 62, and a PVC-molded resonator 52 in the shape of a conic section. The thickness of the resonator 52 was between approximately 0.12 and 0.15 min. The resonator 52 had a base diameter of 220 mm and a depth of 100 mm.

Ten pendulum string strikes were used for average value calculations for each test condition. The table below presents the test results:

| | Average PPM loudness (dBFS) | |
|---|---|---|
| Condition | Open strings | Capo on third fret |
| No guitar amplification | −27.17 | −29.42 |
| With passive amplifier | −17.37 | −21.55 |
| Loudness increase (decibels) | 9.80 | 7.87 |

As the test results indicate, the passive amplifier 50 significantly increases the loudness of the electric guitar 10.

Example 2

The pyramidal-shaped resonator 52 as generally shown in FIGS. 8 and 9 was formed from an approximately 300×300 mm square of polyester film with a thickness of approximately 0.12 mm thickness.

The conic-shaped resonator 52 as generally shown in FIGS. 6 and 7 was formed from an approximately 310 mm diameter circle of polyester film with a thickness of approximately of 0.12 mm thickness.

The resonators 52 were alternatively attached to pickups 54 made from Douglas Fir with 15×19 mm cross-sections, a 9.5-mm hole drilled on the first end 60 and a 6-mm diameter hole on the second end 62, and a 1.0-mm resonating gap on the second end 62.

The passive amplifier 50 was tested on a Fender Jazz Bass fretless, four string guitar. A Samson GoMic condenser-type microphone was used to record the same note sequence played on the electric guitar 10. The microphone was positioned at the same distance from the headstock 16 for each recording.

The recorded sound was analyzed with Audacity recording software. The results are presented in the table below:

| Passive Amplification System | Average loudness in frequency band 40 to 345 Hz (dB) | Loudness increase (dB) |
|---|---|---|
| No amplification | −51.9 | 0 |
| Conic resonator | −41.5 | 10.4 |
| Pyramidal resonator | −38.4 | 13.5 |

As the test results indicate, the passive amplifier 50 significantly increases the loudness of the electric guitar 10, with the pyramidal-shaped resonator 54 performing better than the conic-shaped resonator 54.

It will be appreciated by those skilled in the art that the preferred embodiment has been described in some detail but that certain modifications may be practiced without departing from the principles of the invention.

The invention claimed is:

1. An amplifier for a stringed instrument with a headstock, said amplifier comprising:
   - a post comprising:
     - first and second ends, wherein said post is removably attached to said headstock proximate to said second end; and
     - an aperture extending longitudinally through said post between said first end and said second end; and
   - a resonator attached to said post proximate to said first end, wherein said resonator comprises a generally flared structure;
   - wherein said post transmits vibrations of said headstock to said resonator.

2. The amplifier of claim 1, wherein said aperture comprises a first diameter at the first end and a second diameter at the second end.

3. The amplifier of claim 2, wherein said first diameter is greater than said second diameter.

4. The amplifier of claim 1, wherein said post has a generally rectangular cross-section.

5. The amplifier of claim 1, wherein said post is made of one or more of the following materials: wood, plastic, glass fiber composites, graphite composites, and aluminum.

6. The amplifier of claim 5, wherein said post is made of wood of one or more of the following types: Douglas Fir, Western Hemlock, Sitka Spruce, Radiata Pine, and Mahogany.

7. The amplifier of claim 1, wherein said post extends substantially normal to said headstock.

8. The amplifier of claim 1, wherein said post further comprises a resonating gap proximate to said second end, wherein said resonating gap comprises a passageway between said aperture and an exterior of said post.

9. The amplifier of claim 1, wherein said generally flared structure comprises a generally conic structure.

10. The amplifier of claim 1, wherein said generally flared structure comprises a generally pyramidal structure.

11. The amplifier of claim 1, wherein said post further comprises a fastener opening proximate to said first end, and said resonator comprises a resonator opening proximate to an apex of said resonator.

12. The amplifier of claim 11, further comprising a fastener engaging both said fastener opening and said resonator opening to secure said resonator to said post.

13. The amplifier of claim 12, wherein said fastener comprises a bolt.

14. The amplifier of claim 12, further comprising a resonating strip and one or more spacers, wherein said resonating strip is situated between said post and said resonator, and wherein said spacers separate said resonating strip from said post.

15. The amplifier of claim 14, wherein said resonating strip comprises a strip opening for engagement with said fastener.

16. The amplifier of claim 1, wherein said resonator is made of one or more of the following materials: paper, plastic film, wood veneer, metallic foil, and polyester film.

17. The amplifier of claim 1, wherein said resonator is formed from a substantially flat cutout, wherein said cutout comprises a slit separating two adjacent edges and wherein one of said adjacent edges is slid across another of said adjacent edges to form said generally flared structure.

18. The amplifier of claim 17, wherein said cutout is generally circular or generally rectangular in shape.

19. The amplifier of claim 17, wherein said cutout is capable of being rolled into a generally cylindrical shape for storage.

20. The amplifier of claim 1, wherein said resonator is molded.

21. The amplifier of claim 12, further comprising a stiffener, wherein said stiffener comprises a stiffener opening for engagement with said fastener, and wherein at least a portion of said stiffener comes into contact with an interior surface of said resonator.

22. The amplifier of claim 21, wherein said stiffener is made of one or more of the following materials: paper and plastic.

23. The amplifier of claim 22, wherein said stiffener is made from material thicker than that of said resonator.

24. The amplifier of claim 1, further comprising an attachment mechanism for removably attaching said post to said headstock.

25. The amplifier of claim 24, wherein said attachment mechanism comprises one of the following: clamp, clip, clasp, strap, bolt, and tie.

26. The amplifier of claim 24, wherein said post comprises an attachment point for engagement of said post with said attachment mechanism.

* * * * *